US006045422A

United States Patent [19]

Widmann

[11] Patent Number: 6,045,422

[45] Date of Patent: Apr. 4, 2000

[54] WEDGE WITH ANGULARLY ADJUSTABLE POSITIONS

[75] Inventor: George F. Widmann, Palm Harbor, Fla.

[73] Assignee: Eco Sound Inc., Tarpon Springs, Fla.

[21] Appl. No.: 09/227,443

[22] Filed: Jan. 8, 1999

[51] Int. Cl.[7] ..... B63H 21/32

[52] U.S. Cl. ..... 440/89; 181/238

[58] Field of Search ..... 440/88, 89; 181/235, 181/238

[56] References Cited

U.S. PATENT DOCUMENTS

| | | | |
|---|---|---|---|
| 4,002,136 | 1/1977 | Michalak | 440/89 |
| 4,744,778 | 5/1988 | Porter | 440/89 |
| 4,977,977 | 12/1990 | Von Widmann et al. | 440/89 |
| 5,094,640 | 3/1992 | Burdick et al. | 440/89 |
| 5,719,358 | 2/1998 | Lindholm | 440/89 |
| 5,846,107 | 12/1998 | Widmann | 440/89 |

*Primary Examiner*—Jesus D. Sotelo
*Attorney, Agent, or Firm*—Harold D. Shall

[57] ABSTRACT

An exhaust processing system for a boat including an exhaust chamber having an exhaust opening in the rear bottom thereof, and a wedge plate is pivotally mounted at the forward end of the opening. Controls are provided to pivot the wedge to thereby change the negative pressure in the exhaust chamber

3 Claims, 2 Drawing Sheets

WEDGE WITH ANGULARLY ADJUSTABLE POSITIONS

BACKGROUND OF THE INVENTION

1) Field of the Invention

This invention relates to improvements to the member 40 of application Ser. No. 08/880,143, filed Jun. 20, 1997, now U.S. Pat. No. 5,846,107 and the external wedge member 66 of application Ser. No. 09/045,689, filed Mar. 23, 1998, and more particularly to a wedge having angularly adjustable positions for a marine engine exhaust processing system.

2) Description of the Prior Art

Marine engine exhaust processing systems wherein the exhaust is directed downwardly and through an opening in the rear bottom of the boat hull, such as shown in the above two applications, while having a wedge member, do not provide for movement of such member to change the angle thereof and thereby favorably change the back pressure within the exhaust chamber as desired. While U.S, Pat. No. 40,002,136 shows an exhaust chamber, there is nothing even resembling a wedge member to enhance the negative back pressure within the exhaust chamber.

It is therefore an object of this invention to provide a wedge member on the bottom of the hull of a boat whose position may be varied relative to an exhaust passage in the hull bottom to thereby vary the pressure in an exhaust chamber which discharges exhaust through such exhaust passage.

SUMMARY OF THE INVENTION

This invention includes a wedge member which is secured to the boat bottom just forward of the exhaust opening in the rear bottom of a boat hull, which opening leads from an exhaust chamber within the hull into which the exhaust is deposited by the engine's manifold, and which wedge member's position relative to the hull bottom and exhaust opening can be modified. This modification can take place by activating remotely controlled operating means; such as a hydraulic cylinder activated by a signal from a suitable control.

DETAILED DESCRIPTION OF THE PREFERRED EMBODIMENT

Figure 1:
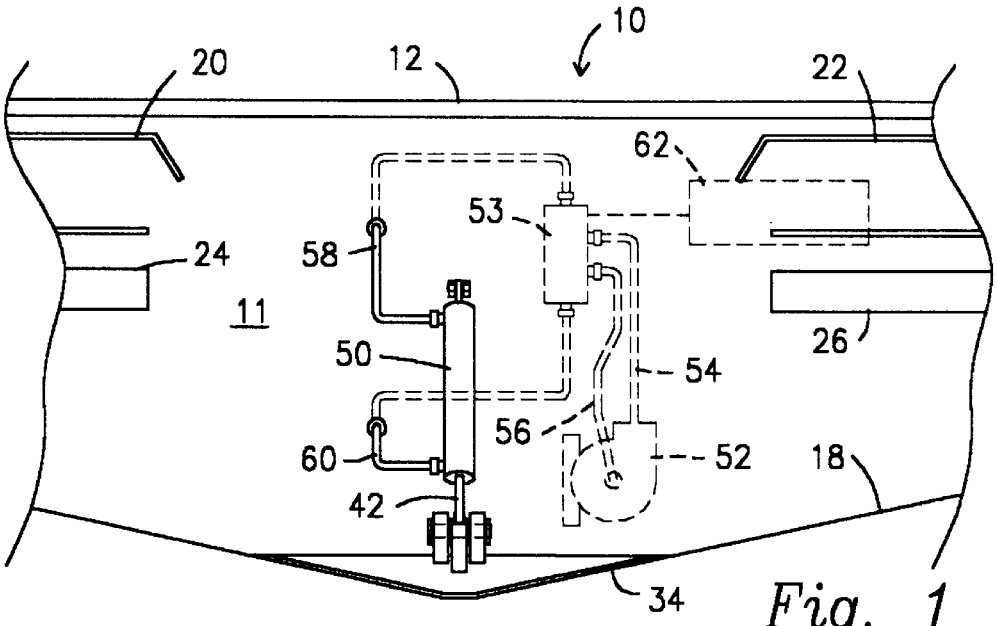
FIG. 1 is a cross sectional view taken along the lines 1—1 in FIG. 3.
Figure 2:
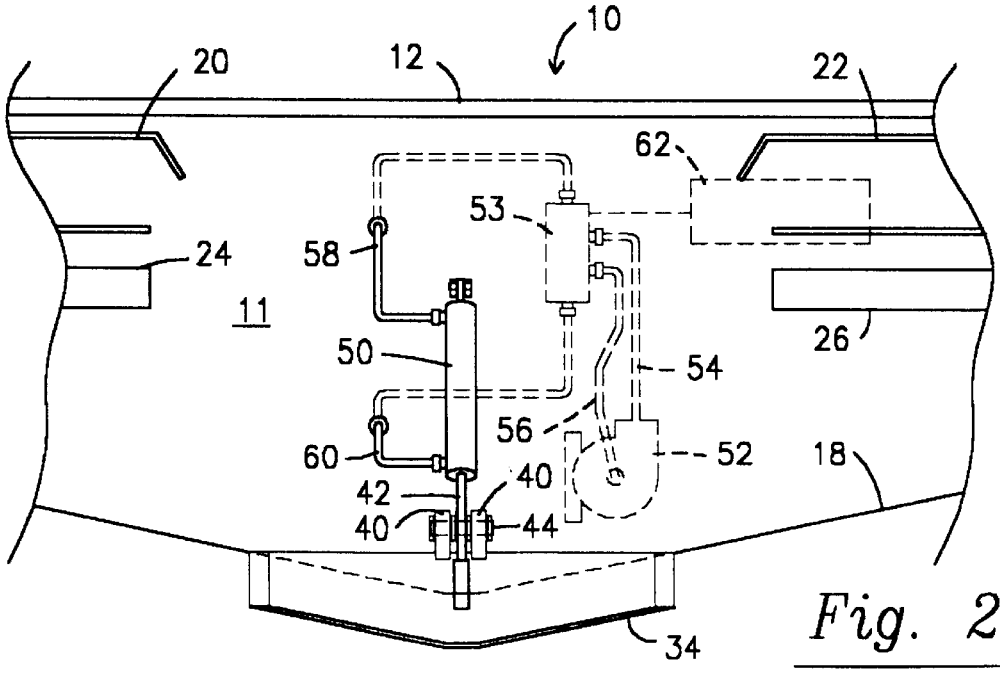
FIG. 2 is a cross sectional view taken along the lines 2—2 in FIG. 4.

A boat hull shown generally at 10, includes an a exhaust chamber 11 having an upper wall in the form of an exhaust chamber top wall 12, an exhaust chamber rear wall 14, which could be the transom of the boat or a separate wall installed behind the normal transom, an exhaust chamber front wall 16, and an exhaust chamber bottom wall 18, which could be the bottom of the hull 10. In FIGS. 1 and 2, the exhaust manifolds 20 and 22 from the boats engines (not shown) are fragmentarily shown as entering the chamber 11 above a pair of low speed chamber exhausts 24 and 26, the latter exiting the chamber above the stationary waterline, whereby at rest or at low speeds, the exhaust from the chamber can exit through the low speed exhausts.

In the rear bottom of the hull is a high speed exhaust opening 28 underlying an exhaust plate 30, the latter commencing at the junction of the rear wall 14 and the chamber bottom wall 18 at the central portion thereof. The plate 30 angles upwardly and forward from such junction whereby the forward end thereof is spaced above the bottom wall 18 to thereby provide an opening 32, under plate 30 and through the opening 28, through which exhaust gasses can flow from the chamber 11 when the boat is on plane. The plate 30 has laterally opposed side walls, one of which is shown at 31, and the side walls 31 each have an opening 33 therein for additional exhaust passage.

Figure 3:
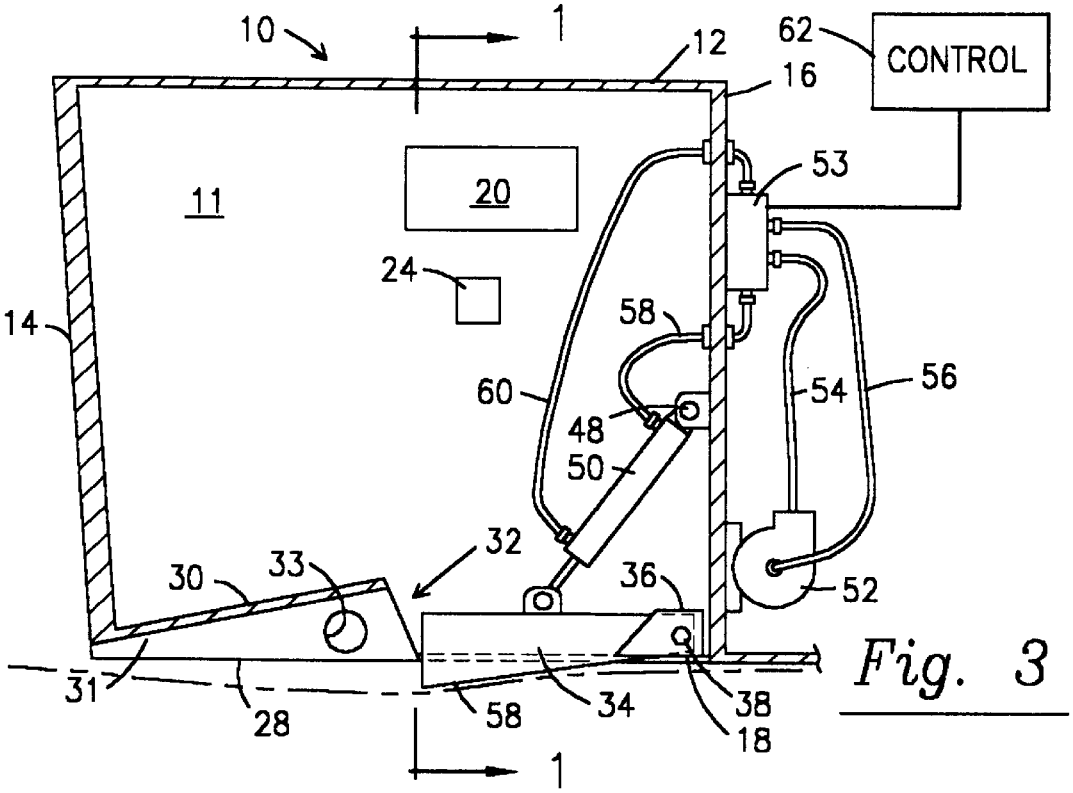
FIG. 3 is a longitudinal sectional view of an exhaust chamber at the aft end of a boat including an exhaust wedge according to this invention, with the wedge in its "up" position and the hull in an "on plane" attitude.
Figure 4:
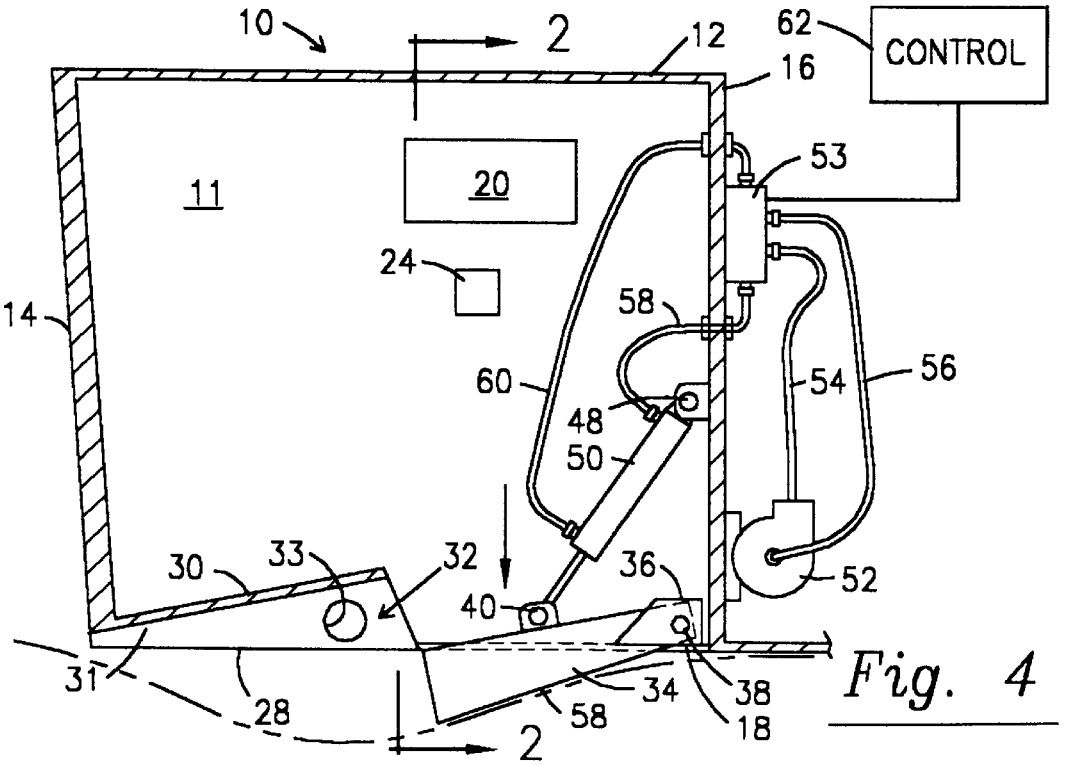
FIG. 4 is a view like FIG. 3 with the wedge in a "down" position.

The exhaust opening 28 has a portion thereof which extends forward of the plate 30, and an adjustable wedge 34 is positioned in this opening as hereinafter described. As shown in FIG. 1, the wedge 34 is shaped in lateral section so as to conform to the contour of the hull bottom 18. If the bottom 18 has a "V" shape, so will the wedge 34. Similarly, if the hull bottom is flat or rounded, so will be the wedge. A pair of mounting brackets, one of which is shown at 36 in FIGS. 3 and 4, are laterally spaced on opposed sides of the opening 28 at the forward end thereof, and have a central opening therein which receives a cross-pivot pin 38, which pin is also received in an aligned opening in the adjustable wedge 34, whereby the rear end of the wedge 34 can move upwardly and downwardly. A pair of mounting bosses 40 are fixedly secured to the top center of the wedge 34, and the distal end of the hydraulic piston 42 is operatively secured to the bosses by a cross pin 44 in a conventional manner. A boss 46 is fixedly secured to the inner side of the forward wall 16 at a location above the bracket 36, and a pin 48 passes through aligned openings in the boss 46 and the top end of a hydraulic cylinder 50, to operatively secure the latter to the former in a conventional manner. Upon actuation of the cylinder 50, the wedge 34 can be pivoted upwardly or downwardly. When pivoted upwardly, the lower surface 58 of the wedge 34 is shown at FIG. 3 to be slightly below the bottom of the hull 18. When pivoted downwardly as seen in FIG. 4, the lower surface 58 of the wedge 34 is angled substantially below the hull bottom 18. It should be noted that the greater the downward angle of the wedge 34, within limits, the greater will be the negative pressure at the opening 32 and within the chamber 11. Means are provided to actuate the hydraulic cylinder 50. More particularly, a hydraulic pump, shown schematically at 52, is positioned forward of the wall 16 and supplies hydraulic pressure to the input of a valve body 53 through a line 54, and a line 60 returns hydraulic fluid to the pump 52. From the valve body 53, a line 58 conducts fluid from the valve body 53 to the top of the cylinder 50 to cause the latter to extend the piston 42, while returning fluid from the distal end of the piston to the valve body through a line 60 to thereby move the wedge 34 downwardly. Conversely, when it is desired to move the wedge upwardly, the valve body directs fluid to the distal end of the cylinder 50 through the line 60, while returning fluid to the valve body through the line 58. This upward and downward movement of the wedge translates into a greater or lesser angular relationship, respectively, of the wedge 34 relative to the bottom of the of the hull 18. At the greater angle, a greater pressure drop occurs at the rear end of the wedge, which results in a greater negative pressure in the chamber 11, than at a lesser angle; conversely, reducing the angle of the wedge results in reduction of the negative pressure in the chamber 11.

A control 62 is provided to actuate the valve body 53. This can take the form of a manually operative control which the boat operator manipulates in response to certain indicia or to his best judgement. The indicia can be a GPH fuel flow meter and/or a vacuum gauge. This feature allows the boat operator, at his finger tips the ability to fine tune the exhaust flow for maximum performance. It should be noted that an indexing electric motor with suitable connections can be substituted for the pump 52 and cylinder 50, as can a mechanical connection between the operator and the wedge.

While only a single embodiment has been shown and described, it is contemplated that many changes can be made therein without departing from the scope of the invention as defined in the following claims.

What is claimed is:

1. An exhaust processing system for a boat having an exhaust chamber for receiving exhaust from an engine's manifold and which chamber has an exhaust opening in the bottom thereof and with the exhaust in the chamber exiting through the exhaust opening during operation of the boat, and having a wedge at the forward end of said opening, characterize in that said wedge has a forward and a rearward end and includes means pivotally mounting said forward end of said wedge to the bottom of said chamber at the forward end of said exhaust opening and said system includes means for pivoting said rearward end of said wedge toward or away from said exhaust opening thereby to change the pressure in said exhaust chamber.

2. A system according to claim 1 further characterize in that said exhaust system has a low speed exhaust above said exhaust opening for discharging exhaust at low speeds, and said exhaust opening exhausts exhaust at higher boat speeds.

3. A system according to claim 2 wherein when said rearward end of said wedge is pivoted away from said opening, the negative pressure in said chamber is made to be more negative.

* * * * *